US005737376A

United States Patent [19]

Hirose

[11] Patent Number: 5,737,376

[45] Date of Patent: Apr. 7, 1998

[54] SMALL AND INEXPENSIVE SLOW POSITRON BEAM GENERATING DEVICE CAPABLE OF GENERATING A SLOW POSITRON BEAM HAVING A HIGH INTENSITY

[75] Inventor: Masafumi Hirose, Kanagawa, Japan

[73] Assignee: Sumitomo Heavy Industries, Ltd., Tokyo, Japan

[21] Appl. No.: 716,046

[22] Filed: Sep. 19, 1996

Related U.S. Application Data

[63] Continuation of Ser. No. 480,943, Jun. 7, 1995, abandoned, which is a continuation of Ser. No. 141,088, Oct. 26, 1993, abandoned.

[30] Foreign Application Priority Data

Oct. 27, 1992 [JP] Japan ..... 4-288335

[51] Int. Cl.$^6$ ..... G21G 1/10

[52] U.S. Cl. ..... 376/194; 376/199

[58] Field of Search ..... 376/190, 194–201

[56] References Cited

U.S. PATENT DOCUMENTS

| | | | |
|---|---|---|---|
| 4,252,668 | 2/1981 | Lembrecht et al. | 376/195 |
| 4,800,060 | 1/1989 | Goldring | 376/194 |
| 4,812,775 | 3/1989 | Klinkowstein et al. | 376/190 |
| 4,894,208 | 1/1990 | Griffin et al. | 376/195 |
| 5,037,602 | 8/1991 | Dabiri et al. | 376/198 |
| 5,204,072 | 4/1993 | Phillips | 376/156 |
| 5,280,505 | 1/1994 | Hughey et al. | 376/194 |

OTHER PUBLICATIONS

Int. J. of Applied Radiation and Isotopes, vol. 30, pp. 250–254, 1979, Richards et al(I).

The Uses of Cyclotrons in Chemistry, Metallurgy and Biology, (Proc. of Conf. held at St. Catherine's College, Oxford, Sep. 1969, Edited by Amphlett, pp. 138–148.

BNL–18214, (1973), Richards et al(II), pp. 1–5, Fig. 1, Table 1.

Nuclear Physics, vol. 24, (1961), pp. 675–681, James.

Y. Ito et al., "Intense Brightness Enhanced Positron Beam From An Electron LINAC And Its Applications," Materials Science Forum, vols. 105–110 (1992) pp. 1893–1896.

P. Schultz et al., "interaction Of Positron Beam With Surfaces, Thin Films, And Interfaces," Reviews of Modern Physics, vol. 60, No. 3, Jul. 1988, pp. 701, 716, 723–726.

R. Suzuki et al., "Positron Pulsing System For Variable Energy Positron Lifetime Spectroscopy," Materials Science Forum, vols. 105–110 (1992) pp. 1993–1996.

D. Schödlbauer et al., "A Pulsing System For Low Energy Positrons," Nuclear Instruments and Methods in Physics Research B34 (1988) pp. 258–268.

N. Zafer et al., "Positron Beam Experimentation," Materials Science Forum, vols. 105–110 (1992) pp. 2017–2020.

Rev. Sci. Instrum., vol. 45, vol. 45, No. 7, (Jul. 1974), pp. 951–953, Stein et al.

Nuclear Instruments and Methods, vol. 125, No. 3 (1975), pp. 429–433, Ansaldo et al.

J. of Physics E: Scientific Instruments, vol. 19, Apr. 1986, pp. 282, 283, Hutchins et al.

Can. J. Phys., vol. 50, (1972), pp. 1414–1418, Jaduszliwer et al.

J. Phys. B: Atom. Molec. Phys., vol. 5, Aug. 1972, pp. L167–L169, Canter et al(I).

(List continued on next page.)

*Primary Examiner*—Harvey E. Behrend

*Attorney, Agent, or Firm*—Burns, Doane, Swecker & Mathis, LLP

[57] ABSTRACT

In a slow positron beam generating device having a cyclotron for irradiating protons or deuterons during an irradiating time interval, a target member receives the protons or the deuterons to generate radioisotopes which emit positrons by causing $\beta^+$ decay. Ejecting electrodes receive the positrons moderated by a moderator to eject a slow positron beam. The irradiating time interval is longer than a half life of the radioisotope. Preferably, the irradiating time interval is longer than a six multiplied by the half life of the radioisotope.

4 Claims, 2 Drawing Sheets

OTHER PUBLICATIONS

Phys. Rev. B, vol B5 (1972), pp. 1433–1436, Costello et al.
Int. J. Appl. Radiat. Isot., vol. 26, (1975), pp. 763–770, Servian.
Int. J. Appl. Radiat. Isot., vol. 33, (1982), pp. 619–628, Solar et al.
Int. J. Appl. Radiat. Isot., vol. 35, No. 8, (1984), pp. 721–729, Jones et al.

Positron Studies of Solids, Surfaces, and Atoms, pub. by World Scientific Pub. Co. Pte. Ltd., Singapore, (1986), Article by Canter et al(II) on pp. 199–207.

SMALL AND INEXPENSIVE SLOW POSITRON BEAM GENERATING DEVICE CAPABLE OF GENERATING A SLOW POSITRON BEAM HAVING A HIGH INTENSITY

This application is a continuation of application Ser. No. 08/480,943, filed Jun. 7 1995, now abandoned which is a continuation of application Ser No. 08/141,088, filed Oct. 26, 1993, now abandoned.

BACKGROUND OF THE INVENTION

This invention relates to a slow positron beam generating device.

A conventional slow positron beam generating device comprises an emitting device which emits a slow positron beam by using radioisotopes which have a long life. This slow positron beam generating device is incapable of generating the slow positron beam having a high intensity.

Another conventional slow positron beam generating device comprises a linear accelerator for accelerating an electron beam. This slow positron beam generating device is large and highly expensive.

SUMMARY OF THE INVENTION

It is therefore an object of this invention to provide a slow positron beam generating device which is capable of generating a slow positron beam having a high intensity.

It is another object of this invention to provide a slow positron beam generating device which is small and inexpensive.

Other objects of this invention will become clear as the description proceeds.

According to an aspect of this invention, there is provided a slow positron beam generating device which comprises (A) a cyclotron for supplying protons during an irradiating time interval; (B) a target member for receiving the protons from the cyclotron to generate radioisotopes which emit positrons by causing $\beta^+$ decay; (C) a moderator for receiving the positrons emitted from the radioisotopes to moderate the positrons; and (D) a plurality of ejecting electrodes for receiving the positrons from the moderator to eject a slow positron beam; the irradiating time interval being longer than a half life of the radioisotope.

According to another aspect of this invention, there is provided a slow positron beam generating device which comprises (A) a cyclotron for supplying protons during an irradiating time interval; (B) a target member for receiving the protons from the cyclotron to generate radioisotopes which emit positrons by causing $\beta^+$ decay; (C) a moderator for receiving the positrons emitted from the radioisotopes to moderate the positrons; (D) a plurality of ejecting electrodes for receiving the positrons from the moderator to eject a slow positron beam; and (E) beam transferring means for receiving said slow positron beam from said ejecting electrodes and for receiving said slow positron beam from said ejecting electrodes snd for transferring the slow positron beam for positron analysis; the irradiating time interval being longer than a half life of the radioisotope.

According to still another aspect of this invention, there is provided a slow positron beam generating device which comprises (A) a cyclotron for supplying deuterons during an irradiating time interval; (B) a target member for receiving the deuterons from the cyclotron to generate radioisotopes which emit positrons by causing $\beta^+$ decay; (C) a moderator for receiving the positrons emitted from the radioisotopes to moderate the positrons; and (D) a plurality of ejecting electrodes for receiving the positrons from the moderator to eject a slow positron beam; the irradiating time interval being longer than a half life of the radioisotope.

According to yet another aspect of this invention, there is provided a slow positron beam generating device which comprises (A) a cyclotron for supplying deuterons during an irradiating time interval; (B) a target member for receiving the deuterons from the cyclotron to generate radioisotopes which emit positrons by causing $\beta^+$ decay; (C) a moderator for receiving the positrons emitted from the radioisotopes to moderate the positrons; (D) a plurality of ejecting electrodes for receiving the positrons from the moderator to eject a slow positron beam; and (E) beam transferring means for receiving said slow positron beam from said ejecting electrodes and for transferring the slow positron beam; the irradiating time interval being longer than a half life of the radioisotope.

DESCRIPTION OF THE PREFERRED EMBODIMENTS

Figure 1:
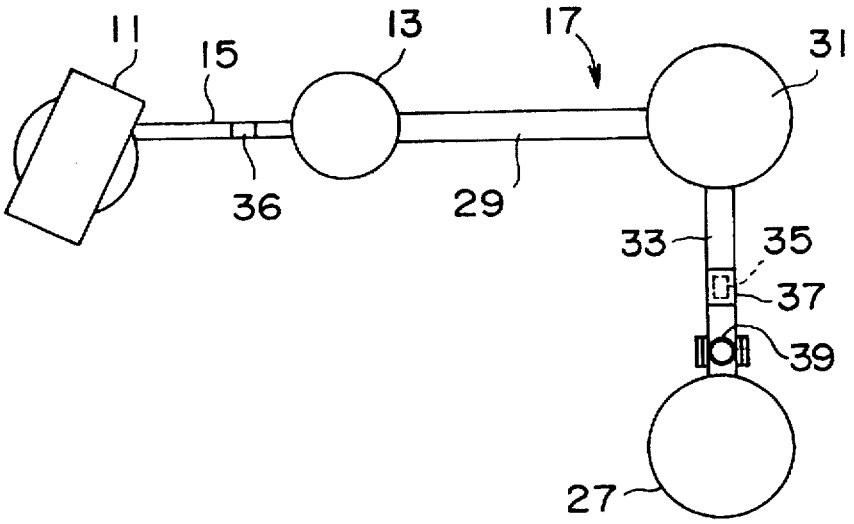
FIG. 1 is a horizontal view of a slow positron beam generating device according to a first embodiment of this invention.
Figure 2:
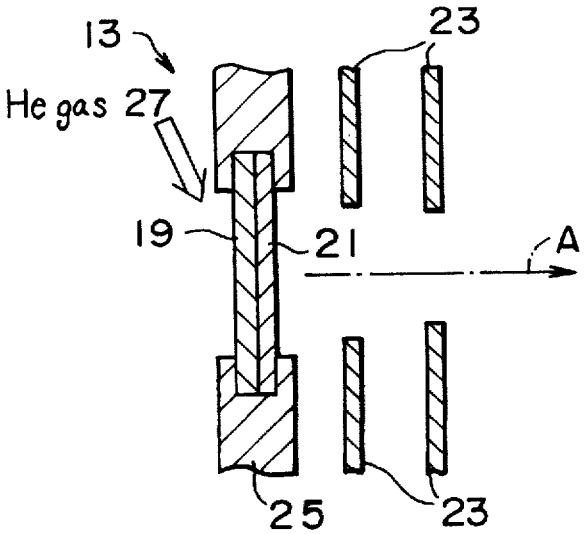
FIG. 2 is a greatly enlarged detailed horizontal sectional view of a part of the slow positron beam generating device illustrated in FIG. 1.

Referring to FIGS. 1 and 2, the description will proceed to a slow positron beam generating device according to a first embodiment of this invention.

In FIG. 1, the slow positron beam generating device comprises a cyclotron 11, a slow positron beam generating unit 13 connected to the cyclotron 11 through a tube 15, and a beam transferring unit 17 connected to the slow positron beam generating unit 13. The cyclotron 11 is for irradiating protons or deuterons during an irradiating time interval. Each of the protons or the deuterons has an energy of 10 to 20 MeV and a current value of 50 to 100 μA. The slow positron beam generating unit 13 is supplied with the protons or the deuterons from the cyclotron 11 through the tube 15.

In FIG. 2, the slow positron beam generating unit 13 comprises a target member 19, a moderator 21, and a plurality of ejecting electrodes 23. The target member 19 receives the protons or the deuterons from the cyclotron 11 to generate radioisotopes (that is, β decay radioisotopes) which emit (that is fast positrons) by causing $\beta^+$ decay. The moderator 21 receives the positrons emitted from the radioisotopes to moderate the positrons into slow positrons (i.e., positrons which are slower than the relatively fast positrons emitted from the radioisotopes). Each of the ejecting electrodes 23 is supplied with a voltage of a predetermined polarity from power supply units (not shown). The ejecting electrodes 23 receive the positrons from the moderator 21 to eject the positrons as a slow positron beam in a direction shown at A.

The irradiating time interval is longer than a half life of the radioisotope. In this event, the slow positron beam generating unit 13 can generate the positrons which have a high intensity and are in a state of activity saturation. Preferably, the irradiating time interval is longer than a six multiplied by the half life of the radioisotope that is, an irradiating time interval which is longer than six times the half-life.

The target member 19 and the moderator 21 are held by a metal holder 25. The metal holder 25 has a water cooling device (not shown). The target member 19 is cooled by the water cooling device and helium gas 27 which is ejected to the target member 19.

The target member 19 is made of a simple substance or a compound of a material selected from a group consisting of aluminum, boron, nitrogen, fluorine, carbon, oxygen, sodium, and the like.

In a case where the target member 19 was made of aluminum, the target member 19 emits the positrons which have an intensity of $4.5\times10^{11}$ $e^+/s$. In another case where the target member 19 was made of boron nitride, the target member 19 emit the positrons which have an intensity of $8.5\times10^{11}$ $e^+/s$.

The moderator 21 has a negative work function to the positron. The moderator 21 is made of a monocrystal foil of a certain material such as tungsten, nickel, or the like that was annealed in a vacuum space. The moderator 21 may be made of a polycrystal foil of a certain material such as tungsten, nickel, or the like that was annealed in the vacuum space. The moderator 21 has a conversion efficiency which is greater than $10^{-4}$. The positrons ejected from the moderator 21 have an intensity of about $4.5\times10^7$ to $8.5\times10^8$ $e^+/s$. In a case where the target member 19 has a negative work function to the positron, the moderator 21 may be removed from the slow positron beam generating unit 13.

Turning back to FIG. 1, the beam transferring unit 17 is for transferring the slow positron beam from the slow positron beam generating unit 13 to a positron analyzer 27.

The beam transferring unit 17 comprises a first electrostatic lens 29 connected to the slow positron beam generating unit 13, an energy sorting device 31 connected to the first electrostatic lens 29, and a second electrostatic lens 33 connected between the energy sorting device 31 and the positron analyzer 27.

The first electrostatic lens 29 is supplied with the slow positron beam from the slow positron beam generating unit 13 to transfer the slow positron beam to the energy sorting device 31. The energy sorting device 31 is supplied with the slow positron beam from the first electrostatic lens 29 and sorts out the slow positron beam. The second electrostatic lens 33 is supplied with the slow positron beam from the energy sorting device 31 to transfer the slow positron beam to the positron analyzer 27.

A positron beam accelerator 35 is disposed in the beam transferring unit 17. In this event, a first insulator 36 and a second insulator 37 are electrical insulators of a tube shape similar to the tube 15 and to the beam transferring unit 17 and are interposed or inserted in the tube 15 and the beam transferring unit 17, respectively. A deflection coil 39 is disposed in the beam transferring unit 17. The deflection coil 39 finely controls a position of the slow positron beam.

The beam transferring unit 17 may comprise a brightness enhancement device or a pulse forming device.

Figure 3:
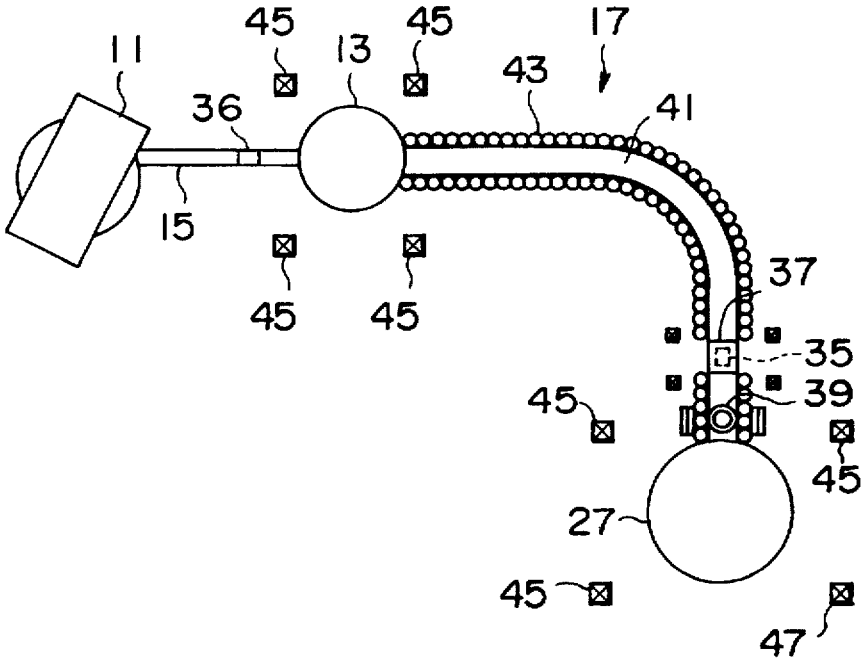
FIG. 3 shows a horizontal view of a slow positron beam generating device according to a second embodiment of this invention, with a portion cut away.

Referring to FIG. 3, the description will proceed to a slow positron beam generating device according to a second embodiment of this invention. Similar parts are designated by like reference numerals.

The beam transferring unit 17 comprises a transfer tube 41 connected between the slow positron beam generating unit 13 and the positron analyzer 27, a solenoid coil 43 disposed around the transfer tube 41, and Helmholtz coils 45 around the slow positron beam generating unit 13 and the positron analyzer 27. The transfer tube 41 is for passing the slow positron beam from the slow positron beam generating unit 13 to the positron analyzer 27. The solenoid coil 43 and the Helmholtz coils 45 are supplied with direct currents from power supply units (not shown) to produce magnetic fields for transferring the slow positron beam from the slow positron beam generating unit 13 to the positron analyzer 27.

In FIGS. 1 and 3, one of devices for using the slow positron beam may be connected to the beam transferring unit 13 instead of the positron analyzer 27.

What is claimed is:

1. A method of generating a slow positron beam by using a target member for receiving protons to generate β+ decay radioisotopes which emit fast positrons by causing β+ decay, said method comprising the steps of:

preparing a cyclotron as a source for producing said protons;

making said cyclotron irradiate said target member by said protons during an irradiating time interval which is longer than six times a half life of each of said radioisotopes;

making a moderator moderate said fast positrons emitted from said target member into slow positrons which are slower than said fast positrons; and making an ejecting electrode eject said slow positrons as said slow positrons beam.

2. A method of generating a slow positron beam by using a target member for receiving protons to generate β+ decay radioisotopes which emit fast positrons by causing β+ decay, said method comprising the steps of:

preparing a cyclotron as a source for producing said protons;

making said cyclotron irradiate said target member by said protons during an irradiating time interval which is longer than six times a half life of each of said radioisotopes;

moderating said fast positrons emitted from said target member into slow positrons which are slower than said fast positrons; and ejecting said slow positrons as said slow positron beam.

3. A method of generating a slow positron beam by using a target member for receiving deuterons to generate β+ decay radioisotopes which emit fast positrons by causing β+ decay, said method comprising the steps of:

preparing a cyclotron as a source for producing said deuterons;

making said cyclotron irradiate said target member by said deuterons during an irradiating time interval which is longer than six times a half life of each of said radioisotopes;

making a moderator moderate said fast positrons emitted from said target member into slow positrons which are slower than said fast positrons; and making an ejecting electrode eject said slow positrons as said slow positron beam.

4. A method of generating a slow positron beam by using a target member for receiving deuterons to generate β+ decay radioisotopes which emit fast positrons by causing β+ decay, said method comprising the steps of:

preparing a cyclotron as a source for producing said deuterons;

making said cyclotron irradiate said target member by said deuterons during an irradiating time interval which is longer than six times a half life of each of said radioisotopes;

moderating said fast positrons emitted from said target member into slow positrons which are slower than said fast positrons; and ejecting said slow positrons as said slow positron beam.

* * * * *